US010083587B1

(12) United States Patent
Sagert et al.

(10) Patent No.: US 10,083,587 B1
(45) Date of Patent: Sep. 25, 2018

(54) AUTOMATIC FIRE EXTINGUISHING SYSTEM AND METHOD FOR COMMISSIONING AND CONFIGURING THEREOF

(71) Applicant: Minimax GmbH & Co. KG, Bad Oldesloe (DE)

(72) Inventors: Holger Sagert, Bad Oldesloe (DE); Felix Tellkamp, Rellingen (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 0 days.

(21) Appl. No.: 16/022,927

(22) Filed: Jun. 29, 2018

Related U.S. Application Data

(63) Continuation of application No. 15/572,197, filed as application No. PCT/EP2016/059535 on Apr. 28, 2016, now Pat. No. 10,037,664.

(30) Foreign Application Priority Data

May 8, 2015 (DE) ..... 10 2015 207 607

(51) Int. Cl.

| | |
|---|---|
| ***G08B 17/00*** | (2006.01) |
| ***A62C 37/40*** | (2006.01) |
| ***G08B 25/14*** | (2006.01) |
| ***A62C 37/36*** | (2006.01) |

(52) U.S. Cl.
CPC ..... *G08B 17/00* (2013.01); *A62C 37/04* (2013.01); *A62C 37/40* (2013.01); *G08B 25/14* (2013.01)

(58) Field of Classification Search
CPC ..... G08B 17/00; A62C 37/04; A62C 37/40
See application file for complete search history.

(56) References Cited

U.S. PATENT DOCUMENTS

2016/0035201 A1* 2/2016 Savage, Jr. ..... G08B 5/38 340/815.45

* cited by examiner

*Primary Examiner* — Curtis Odom
(74) *Attorney, Agent, or Firm* — Smartpat PLC

(57) ABSTRACT

The disclosure relates to an automatic fire extinguishing system. It includes a hazard alarm control unit having a housing, a first electronic assembly and a second electronic assembly which is formed on an outside as an operating and display front panel without a display and has switching elements and luminous indicators and is formed on an inside as an commissioning and configuration unit which comprises configuration parameter selector and a first optical display. The second electronic assembly is connected to the first electronic assembly in a signal-conducting manner and set up such that the set configuration parameters of the configuration parameter selector are accepted by the first electronic assembly for holding and processing in at least one configuration module. The invention also relates to a method for commissioning and configuring an automatic fire extinguishing system.

14 Claims, 2 Drawing Sheets

AUTOMATIC FIRE EXTINGUISHING SYSTEM AND METHOD FOR COMMISSIONING AND CONFIGURING THEREOF

TECHNICAL FIELD

The disclosure relates to an automatic fire extinguishing system and to a method for commissioning and configuring an automatic fire extinguishing system.

BACKGROUND

Hazard alarm control units, also called control unit(s) for short below, are known in various forms. Hazard alarm control units include fire alarm control units, gas detection control units, spark detection control units, spark extinguishing control units, extinguishing control units, and hazard signal acquisition and extinguishing control units.

Hazard alarm control units are operatively connected to hazard detectors and fluid release apparatuses to form automatic fire extinguishing systems. Participants such as hazard detectors, for example gas detectors, fire detectors or spark detectors, are connected to such hazard alarm control units via signal-conducting connections. The hazard alarm control units process the signals from the participants and evaluate them. If a hazardous state is detected, for example a fire, presence of sparks in manufacturing processes or containers, or the exceeding of predefined gas concentration values, the hazard alarm control unit generates and displays a pre-alarm or alarm signal and/or forwards it/them to superordinate systems or to persons. Depending on the intended purpose, the hazard alarm control units are configured, by predefining configuration parameters, such that alarm devices and/or protective devices such as extinguishing systems are controlled in response to an alarm signal.

WO 2004/010399 A1 discloses a fire alarm control unit having a front panel comprising a display and function keys. The hazard alarm control unit is configured by transmitting a configuration file to the hazard alarm control unit.

The disadvantage of known hazard alarm control units is that the configuration is a time-consuming and complex operation which requires the use of a separate computer-aided commissioning and configuration tool such as a PC, a laptop, a smartphone or comparable devices. In addition, when commissioning and/or configuring the hazard alarm control unit, a signal-conducting connection must be established between the computer-aided commissioning and configuration tool and the hazard alarm control unit. Further disadvantages are the high production costs when using displays to display and create the configuration file.

An object of the invention is therefore to provide a hazard alarm control system which enables simplified configuration thereof without using a separate computer-aided commissioning and configuration tool such as a PC, a laptop, a smartphone or comparable devices. At the same time, the production costs are intended to be optimized.

SUMMARY

A hazard alarm control unit comprises a housing and a first electronic assembly which is releasably fastened in the housing and has a central processing unit configured to execute stored programming instructions including at least one configuration module. The hazard alarm control unit further comprises a detector signal acquisition unit and a controlling unit. The hazard alarm control unit also comprises a second electronic assembly. An outside of the second electronic assembly is formed as an operating and display front panel comprising switching elements and luminous indicators. An inside of the second electronic assembly is formed as a commissioning and configuration unit which comprises at least one configuration parameter selector and a first optical display. The second electronic assembly is connected to the first electronic assembly in a signal-conducting manner. Configuration parameters selected with the configuration parameter selector are communicated to the first electronic assembly for holding and processing in the at least one configuration module.

The second electronic assembly is also preferably configured such that configuration parameters set with the configuration parameter selector are received by the first electronic assembly for holding and processing by the at least one configuration module.

The hazard alarm control unit is preferably in the form of a fire alarm control unit, a gas detection control unit, a spark detection control unit, a spark extinguishing control unit, extinguishing control units, or a hazard signal acquisition and extinguishing control unit.

Throughout the description of the invention and in the exemplary embodiments described, the group of words "a configuration module" or "the configuration module" should be understood as meaning "at least one configuration module" or "the at least one configuration module".

In one particularly preferred embodiment, the second electronic assembly is created on the basis of a printed circuit board which has, on the outside, a front membrane with membrane buttons as a switching element and associated luminous indicators in the form of LEDs and preferably transparent insertion pockets for sliding signs. In an operating state of the hazard alarm control unit, the housing is closed and the inside of the second electronic assembly containing the commissioning and configuration unit is directed into the interior of the housing, preferably parallel to the rear mounting wall of the housing.

In one preferred embodiment, the configuration module contains system-specific and project-specific parameters which comprise predefined values, such as the supply voltage of the participants, and time values for the temporal sequence of the control operations after a hazard, fire, or spark has been detected, in particular for an extinguishing control sequence.

This means that the project-specific parameters preferably comprise these predefined values, such as the supply voltage of the participants, and/or time values for the temporal sequence of the control operations after a hazard, fire, or spark has been detected, in particular for an extinguishing control sequence.

The configuration parameters set with the configuration parameter selector are loaded and stored in the configuration module using the central processing unit.

In another embodiment, the detector signal acquisition unit is connected to at least one hazard detector in a signal-conducting manner, preferably to a spark and/or fire detector and/or gas detector. These hazard detectors are also referred to as participants below. Smoke detectors, heat detectors, flame detectors, fire gas detectors, aspirating smoke detectors, manual call points or other suitable hazard detectors are preferably used as fire detectors. Fire detectors are also understood to include spark detectors and/or flame detectors, in particular rapidly reacting flame detectors and/or gas detectors.

The detector signal acquisition unit is preferably equipped with an electronic circuit or measuring circuit for monitoring signal lines for a wire break and short circuit and is also set up and designed such that it receives and processes signals or switching signals from the participants connected to the detector signal acquisition unit via signal lines. The detector signal acquisition unit preferably comprises a processing unit or is controlled by the central processing unit. When preferably acquiring signals or switching signals from spark detectors and/or fire detectors, the events, spark alarm or fire alarm and/or fault are acquired. In one advantageous embodiment, pre-alarm events are also acquired. It is advantageous that it is possible to acquire sparks on a first detector limit value line for a first protected area and to detect fires using fire detectors on a second detector limit value line for a second protected area. Different hazards can therefore be detected using a single hazard alarm control unit, such as instantaneous spark detection in the milliseconds range and fires in the seconds to minutes range with an analysis time for verifying the signals from the detectors in order to determine whether there is a false alarm.

The detector signal acquisition unit is connected to at least one detector limit value line, for example via plug connectors or connection terminals. The detector limit value line can be understood as meaning a connecting line to at least one participant. A two-core line is preferably used and forms a closed circuit with a terminating resistor $R_E$ and at least one participant. This line is also referred to as a signal line below. The detector signal acquisition unit provides a supply voltage, preferably in the range of 9 V to 20 V. If a plurality of participants is used, they are arranged in a parallel circuit with the terminating resistor $R_E$ as the last participant. The circuit of the detector signal acquisition unit and the programming instructions of the central processing unit are configured such that the current is measured in this circuit and the measured currents are assessed according to predefined limit values. Signal lines can therefore be monitored for a wire break and short circuit and signals from participants connected to the detector signal acquisition unit can be acquired and evaluated for alarm values.

In one preferred embodiment, an automatic quiescent current comparison is manually triggered during commissioning, in which the quiescent current of the detector limit value line containing all participants and contact resistances is measured and is stored as a base value, against which all current changes are measured.

The quiescent current $I_0$ and the current changes which are caused by connected participants or by the connection or disconnection of participants and/or by impedance changes in the event of a wire break or short circuit of the signal lines are now continuously measured. If a preset limit value, a current limit value in this embodiment variant, is not reached and/or reached and/or exceeded, this limit value measurement on the detector limit value line is recorded by the detector signal acquisition unit.

In both variants, the detector signal acquisition unit measures the current change and checks whether the preset values or current limit values for the alerting or wire break and/or short circuit are not reached and/or reached and/or exceeded.

The controlling unit controls external components, for example solenoid valves or acoustic signal transmitters. The external components are connected to the controlling unit via control lines via which the necessary operating voltage for the function and commissioning of the external components is provided by the controlling unit in the case of control. The control lines to these external components are monitored for a wire break and short circuit by the controlling unit. The monitoring preferably additionally comprises the presence and the correct state of the connected external components. External components are used in a project-based and system-specific manner from the following list:

- extinguishing fluid release apparatuses such as control magnets, solenoid valves
- alarm devices such as horns and flashing lights
- system parts to be controlled such as discharge flaps, voltage cut-off switches.

In one particularly preferred embodiment, the hazard alarm control unit is connected to spark and/or fire detectors in a signal-conducting manner.

The second electronic assembly is advantageously pivotably arranged on the housing of the hazard alarm control unit. This is advantageous for establishing the quick accessibility for operating the commissioning and configuration unit which is arranged on the inside of the second electronic assembly. The second electronic assembly preferably has a hardware coding unit for generating a selection signal for a configuration module, preferably for the at least one configuration module, or for selecting predefined configuration parameters in the configuration module, preferably in the at least one configuration module.

This hardware coding unit is used to generate a selection signal for a configuration module, preferably for the at least one configuration module, which predefines configuration parameters specific to the protection concept. It is therefore possible to produce and have available different second electronic assemblies with different codings of the hardware coding unit for different protection concepts, for example for the embodiment of the hazard alarm control unit as a spark detection and spark extinguishing control unit or as a fire alarm and extinguishing control unit for controlling water, gas or chemical extinguishing systems. This is advantageous for time-efficient commissioning and configuration of the hazard alarm control unit.

In another embodiment of the hazard alarm control unit, the configuration module is designed to control the functional sequence of a spark extinguishing system.

In another configuration of the hazard alarm control unit, the detector signal acquisition unit is connected to spark detectors and/or rapidly reacting flame detectors in a signal-conducting manner and is designed and set up such that an alarm signal from the spark detectors and/or rapid flame detectors immediately generates, without an analysis time, a control signal from the controlling unit which switches a valve, preferably switches an extinguishing fluid release apparatus, and releases an extinguishing fluid, preferably water, gas or a chemical extinguishing agent, without delay. This has the advantage that the instantaneous application of the extinguishing fluid after spark or flame detection prevents explosions or greater fire damage.

In another embodiment of the hazard alarm control unit, the detector signal acquisition unit is connected to fire detectors in a signal-conducting manner and is designed and set up such that an alarm signal from the fire detectors generates, after expiry of an analysis time, a control signal from the controlling unit which switches a valve and releases the extinguishing fluid. This has the advantage that false alarms and false tripping of the extinguishing system are avoided as a result of the analysis time.

An embodiment of the hazard alarm control unit in which the configuration parameter selector are in the form of DIP switches and/or coded rotary switches is also preferred. The rotary switches are preferably coded in a binary or hexadecimal manner.

The hazard alarm control unit has a first optical display that is in the form of an LED and also preferably has a second optical display of the commissioning and configuration unit which is in the form of a segment display, preferably a seven-segment display.

A plurality of first and second optical displays are preferably arranged. In another configuration of the control unit, a notification title block is also arranged beside the first optical display. One or more notifications which are selected from the following list of notifications are preferably stored there:

- notification of the unauthorized actuation of the configuration parameter selector
- notification that the second electronic assembly is incompatible with the first electronic assembly
- notification that the automatic quiescent current setting is running
- notification that the selected number of sparks per unit time is impermissible or incompatible
- fault messages such as battery faults.

In another configuration of the hazard alarm control unit, the commissioning and configuration unit has a display selection switch which assigns a state display, via the second optical display, to a particular detector limit value line or to a control unit or to the hazard alarm control unit.

For all embodiments, the control unit is preferably in the form of a controlling unit.

A method for commissioning and configuring a hazard alarm control system is carried out using the hazard alarm control unit which comprises

- a housing,
- a first electronic assembly which is releasably fastened in the housing and has a central processing unit configured to execute stored programming instructions including at least one configuration module, a detector signal acquisition unit and a controlling unit, and
- a second electronic assembly which is formed on an outside as an operating and display front panel and has switching elements and luminous indicators and is formed on the inside as an commissioning and configuration unit which comprises a configuration parameter selector and a first optical display,
- the second electronic assembly being connected to the first electronic assembly in a signal-conducting manner and the first electronic assembly being configured to receive configuration parameters from the configuration parameter selector for holding and processing in the at least one configuration module.

The method comprises the following method steps:

- establishing access to the commissioning and configuration unit on the inside of the second electronic assembly;
- switching on a configuration mode;
- selecting a switch position of the configuration parameter selector for predefined configuration parameters;
- transferring configuration parameters to the at least one configuration module;
- switching off the configuration mode; and
- storing the configuration parameters in the first electronic assembly.

Access to the commissioning and configuration unit is preferably established by pivoting the second electronic assembly which is pivotably arranged on the housing or on the first electronic assembly. In an operating state, only the outside of the second electronic assembly, which is in the form of an operating and display front panel without a display, is accessible to the user.

The configuration mode is preferably switched on and off using a pushbutton switch or a sliding switch which is preferably arranged on the inside of the second electronic assembly. In further advantageous embodiments, these switches are arranged on the first electronic assembly or on the outside of the second electronic assembly.

In a particularly preferred configuration of the method, the switch position of the configuration parameter selector for predefined configuration parameters is selected by setting coded switches, in particular rotary switches, and the selected configuration parameters are then accepted into the at least one configuration module by querying the outputs of the coded switches by means of the central processing unit.

In one preferred embodiment of the method, a safety routine for periodically querying the configuration parameters of the commissioning and configuration unit, even after the configuration mode has been switched off, runs in the central processing unit.

This has the advantage that a change in the configuration parameters of the commissioning and configuration unit by actuating the configuration parameter selector is detected and preferably results in a display. The display is effected by the first optical display beside the notification title block which indicates the unauthorized actuation of the configuration parameter selector.

The method is also advantageously developed by the step of comparing the quiescent current by starting an automatic quiescent current comparison, preferably by actuating a quiescent current comparison switch.

In one embodiment of the method, the step of the state query for the hazard alarm control unit and/or for a detector limit value line and/or for a control unit is also activated and the state is displayed by showing alphanumeric characters on a second optical display of the commissioning and configuration unit, the state query preferably being activated by actuating a display selection switch of the commissioning and configuration unit. State displays are preferably for the detector limit value line and the controlling unit: wire break, short circuit, quiescent state, creeping short circuit. The state displays on the second optical display are preferably coded by means of numerical values and/or letters; for example, a wire break is indicated by the displayed character "0", a short circuit is indicated by "5", a quiescent state is indicated by "1" and a creeping short circuit is indicated by "2". This decryption of the coding is preferably arranged in a further notification title block on the inside of the second electronic assembly. This enables time-efficient commissioning and troubleshooting without using additional aids.

In one preferred embodiment of the method, after the configuration mode has been switched on, the configuration parameter "number of sparks per unit time" is set using the configuration parameter selector, preferably by changing the switching position of two coded rotary switches. One coded rotary switch is used to set the number of sparks and a further coded rotary switch is used to set the interval of time. A further configuration parameter selector is additionally used to set the extinguishing time.

The method enables simple and time-efficient configuration of the hazard alarm control unit without using a separate computer-aided commissioning and configuration tool such as a PC, a laptop, a smartphone or comparable devices. There is no need to establish a signal-conducting connection between the computer-aided commissioning and configuration tool and the hazard alarm control unit.

With regard to further advantages of the method, reference is made to the advantages of the hazard alarm control unit.

BRIEF DESCRIPTION OF THE DRAWINGS

Particularly preferred embodiments of the present invention are explained in more detail using the drawings, in which.

DETAILED DESCRIPTION

Figure 1:
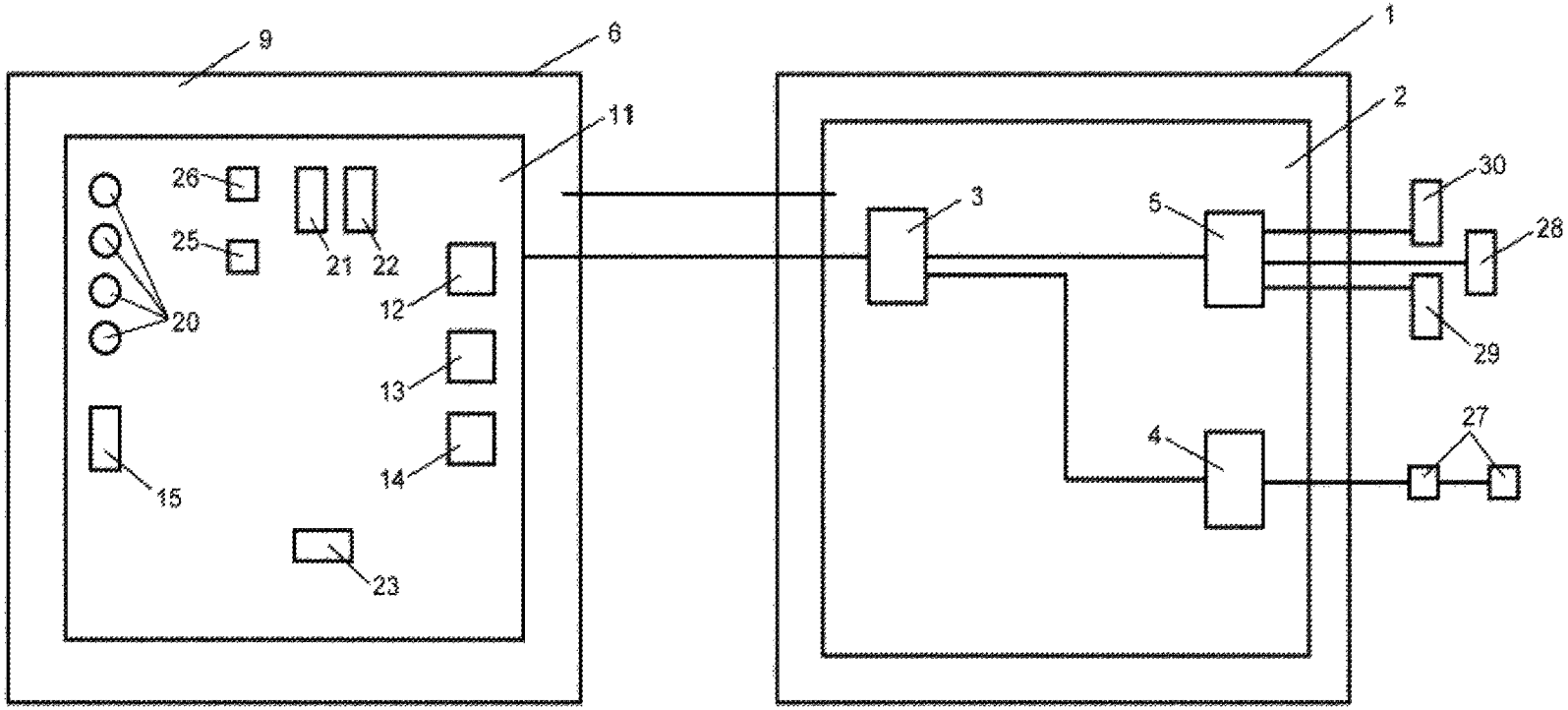
FIG. 1 shows a schematic illustration of an embodiment of the hazard signal acquisition and extinguishing control unit.

The hazard alarm control unit shown in FIG. 1 has a housing 1 and a first electronic assembly 2 which is releasably fastened in the housing 1. The first electronic assembly 2 comprises a central processing unit 3 which is configured to execute stored programming instruction including at least one configuration module (not illustrated). The first electronic assembly 2 further comprises a detector signal acquisition unit 4 and a controlling unit 5. A second electronic assembly 6 is formed on the outside 10 (illustrated in FIG. 2) as an operating and display front panel and comprises switching elements 7 and luminous indicators 8. This second electronic assembly is created on the basis of a printed circuit board which has, on the outside, a front membrane with membrane buttons as a switching element 7 and associated luminous indicators 8 in the form of LEDs and transparent insertion pockets 31 for sliding signs.

FIG. 1 illustrates the inside 9 of the second electronic assembly 6 which is in the form of an commissioning and configuration unit 11. The commissioning and configuration unit 11 comprises configuration parameter selectors 12, 13, 14, 15 and a first optical display 20. The second electronic assembly 6 is connected to the first electronic assembly 2, in particular to the central processing unit 3, in a signal-conducting manner. The second electronic assembly 6 is set up such that the set configuration parameters of the configuration parameter selector are accepted by the first electronic assembly for holding and processing in the at least one configuration module. The configuration parameters are selected using the configuration parameter selectors 12, 13, 14, 15 and are accepted by the first electronic assembly for holding and processing in the at least one configuration module.

Figure 2:
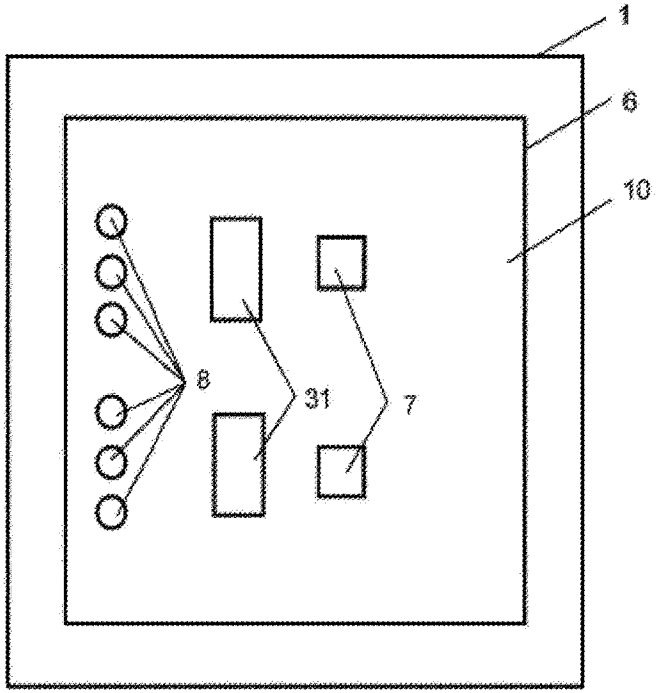
FIG. 2 shows a schematic illustration of an embodiment of the second electronic assembly arranged in the housing of the hazard alarm control unit.

FIG. 2 illustrates the hazard alarm control unit in the operating state with a closed housing 1. In this operating state, only the outside 10 of the second electronic assembly 6 in the form of an operating and display front panel is accessible to the operator. The inside 9 of the second electronic assembly 6 is now directed into the interior of the housing 1, preferably parallel to the rear mounting wall of the housing.

FIG. 1 schematically illustrates an entire system which detects hazards and controls countermeasures. The exemplary embodiment shows a spark detection and spark extinguishing system. The detector signal acquisition unit 4 of the hazard alarm control unit is connected, for example via connection terminals (not illustrated), to a detector limit value line on which hazard detectors 27 in the form of spark detectors 27 are situated. If sparks are detected, the detector signal acquisition unit 4 acquires the alarm signal from the spark detector, and a control signal from the controlling unit 5 is then generated without delay via the central processing unit 3, which control signal controls an extinguishing fluid release apparatus 28, preferably in the form of a valve, in the form of a solenoid valve 28 in the embodiment illustrated, without delay and the extinguishing fluid, for example water, is applied via the nozzles for the purpose of extinguishing the sparks. In this case, the configuration module is designed to control the functional sequence of this spark extinguishing system.

In other embodiments which are not illustrated, the hazard detectors are fire detectors and the extinguishing fluid of water, gas, a gas mixture or a chemical extinguishing agent is released, if a fire is detected, by the controlling unit 5 controlling the extinguishing fluid release apparatus 28 after the expiry of an analysis time, which is predefined as a configuration parameter, and is applied via the nozzles for the purpose of extinguishing the fire.

FIG. 1 shows that the second electronic assembly 6 has a hardware coding unit 23 which is in the form of a resistance network. This is used to generate a selection signal for a configuration module, preferably for the at least one configuration module, which predefines configuration parameters specific to the protection concept. It is therefore possible to produce and have available different second electronic assemblies 6 with different codings of the hardware coding unit 23 for different protection concepts, for example for the embodiment of the hazard alarm control unit as a spark detection and spark extinguishing control unit or as a fire alarm and extinguishing control unit for controlling water, gas or chemical extinguishing systems.

Figure 3:
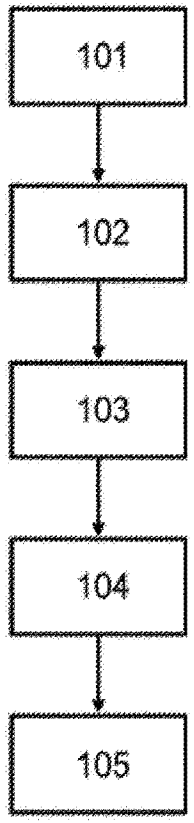
FIG. 3 shows a block diagram of an embodiment of the method.

FIG. 3 schematically shows the sequence of the method for commissioning and configuring a hazard alarm control unit, having the steps of

100) establishing access to the commissioning and configuration unit 11 on the inside 9 of the second electronic assembly 6;

101) switching on the configuration mode;

102) selecting the switch position of the configuration parameter selectors 12, 13, 14, 15 for predefined configuration parameters;

103) transferring configuration parameters to the at least one configuration module;

104) switching off the configuration mode;

105) storing the configuration parameters in the first electronic assembly 2.

LIST OF REFERENCE SYMBOLS

1 Housing
2 First electronic assembly
3 Central processing unit
4 Detector signal acquisition unit
5 Controlling unit/control unit
6 Second electronic assembly
7 Switching elements
8 Luminous indicators
9 Inside of the second electronic assembly
10 Outside of the second electronic assembly
11 Commissioning and configuration unit
12-15 Configuration parameter selectors
20 First optical display
21, 22 Second optical display
23 Hardware coding unit
25 Quiescent current comparison switch
26 Display selection switch
27 Fire detector and/or spark detector
28 Extinguishing fluid release apparatus
29 Alarm devices
30 System part to be controlled, for example discharge flap

The invention claimed is:

1. An automatic fire extinguishing system, having
a hazard detector and
an extinguishing fluid release apparatus in operative connection with
a hazard alarm control unit, the hazard alarm control unit comprising:
a housing;
a first electronic assembly which is releasably fastened in the housing, comprising
a central processing unit configured to execute stored programming instructions including at least one configuration module,
a detector signal acquisition unit, and
a controlling unit; and
a second electronic assembly having
an outside formed as an operating and display front panel comprising switching elements and luminous indicators and
an inside formed as a commissioning and configuration unit comprising at least one configuration parameter selector and a first optical display,
wherein the second electronic assembly is connected to the first electronic assembly in a signal-conducting manner and
wherein the at least one configuration module processes configuration parameters received from the at least one configuration parameter selector.

2. The automatic fire extinguishing system as in claim 1, wherein the hazard alarm control unit is a fire alarm control unit, a spark detection control unit, a spark extinguishing control unit, a extinguishing control unit, or a hazard signal acquisition and extinguishing control unit and
wherein the extinguishing fluid release apparatus is a valve.

3. The automatic fire extinguishing system as in claim 1, wherein the second electronic assembly is pivotably arranged on the housing.

4. The automatic fire extinguishing system as in claim 1, wherein the second electronic assembly comprises a hardware coding unit for generating a selection signal for the at least one configuration module.

5. The automatic fire extinguishing system as in claim 1, wherein the hazard detector is a spark detector connected in a signal-conducting manner with the detector signal acquisition unit, and
wherein the at least one configuration module controls a functional sequence of a spark extinguishing system.

6. The automatic fire extinguishing system as in claim 1, wherein the detector signal acquisition unit is connected to spark detectors and/or rapidly reacting flame detectors in a signal-conducting manner and
wherein an alarm signal from the spark detectors and/or rapidly reacting flame detectors causes an immediate control signal from the controlling unit which activates the extinguishing fluid release apparatus without delay.

7. The automatic fire extinguishing system as in claim 1, wherein the detector signal acquisition unit is connected to fire detectors in a signal-conducting manner and
wherein an alarm signal from the fire detectors generates, after expiry of an analysis time, a control signal from the controlling unit which activates the extinguishing fluid release apparatus.

8. The automatic fire extinguishing system as in claim 1, wherein the extinguishing fluid release apparatus is configured to release an extinguishing fluid which is one of water, a gas, and a chemical extinguishing agent.

9. The automatic fire extinguishing system as in claim 1, wherein the automatic fire extinguishing system is a water, gas or chemical extinguishing system.

10. The automatic fire extinguishing system as in claim 1, wherein the automatic fire extinguishing system is a spark detection and spark extinguishing system.

11. The automatic fire extinguishing system as in claim 1, wherein the hazard detector is at least one participant selected from the group consisting of a smoke detector, a heat detector, a fire gas detector, a spark detector, and a flame detector, and
wherein the at least one participant is operatively connected to the detector signal acquisition unit.

12. The automatic fire extinguishing system as in claim 1, wherein the hazard detector includes
a spark detector operatively connected to the detector signal acquisition unit by a first signal line and
a fire detector operatively connected to the detector signal acquisition unit by a second signal line.

13. A method for commissioning an automatic fire extinguishing system, comprising:
providing a hazard alarm control unit, the hazard alarm control unit having
a housing,
a first electronic assembly which is releasably fastened in the housing, comprising
a central processing unit configured to execute stored programming instructions including at least one configuration module,
a detector signal acquisition unit, and
a controlling unit; and
a second electronic assembly having
an outside formed as an operating and display front panel comprising switching elements and luminous indicators and
an inside formed as a commissioning and configuration unit comprising at least one configuration parameter selector and a first optical display,
wherein the second electronic assembly is connected to the first electronic assembly in a signal-conducting manner and
wherein the at least one configuration module processes configuration parameters received from the at least one configuration parameter selector;
providing an extinguishing fluid release apparatus;
providing a hazard detector selected from the group consisting of a smoke detector, a heat detector, a fire gas detector, a spark detector, and a flame detector;
operatively connecting the extinguishing fluid release apparatus to the controlling unit; and
operatively connecting the hazard detector to the detector signal acquisition unit through a signal line.

14. The method for commissioning a hazard alarm control system as in claim 13, further comprising:
triggering an automatic quiescent current comparison during which a quiescent current through the signal line is measured and stored.

* * * * *